US006569017B2

(12) United States Patent
Enzminger et al.

(10) Patent No.: US 6,569,017 B2
(45) Date of Patent: May 27, 2003

(54) METHOD FOR ASSIGNING PRIZES IN BINGO-TYPE GAMES

(75) Inventors: Joseph Richard Enzminger, Austin, TX (US); John Everett Padgett, Austin, TX (US); David Michael Brandt, Austin, TX (US); Clifton Lind, Austin, TX (US); Gary L. Loebig, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 11 days.

(21) Appl. No.: 09/836,993

(22) Filed: Apr. 18, 2001

(65) Prior Publication Data

US 2002/0155877 A1 Oct. 24, 2002

(51) Int. Cl.[7] ..... H63F 9/24

(52) U.S. Cl. ..... 463/19; 463/16; 463/17; 463/18; 463/20; 463/21

(58) Field of Search ..... 463/16–21; 273/143 R

(56) References Cited

U.S. PATENT DOCUMENTS 4,858,932 A * 8/1989 Keane ..... 273/143 R
4,991,848 A * 2/1991 Greenwood et al. .... 273/143 R
5,275,400 A * 1/1994 Weingardt et al. ..... 273/85 CP
5,401,023 A * 3/1995 Wood ..... 273/85 CP
5,423,539 A * 6/1995 Nagao ..... 273/143 R
5,423,541 A * 6/1995 Nicastro et al. ..... 273/143 R
5,639,088 A * 6/1997 Schneider et al. ..... 273/138.2
6,213,877 B1 * 4/2001 Walker et al. ..... 463/26

FOREIGN PATENT DOCUMENTS

EP 0984408 A2 * 8/1999 ..... G07F/17/32

* cited by examiner

*Primary Examiner*—S. Thomas Hughes
*Assistant Examiner*—Carmen D. White
(74) *Attorney, Agent, or Firm*—Russell D. Culbertson; Shaffer & Culbertson, L.L.P.

(57) ABSTRACT

A method according to the invention includes determining a pattern probability for each of a number of target patterns achievable in a bingo-type game. Each pattern probability comprises a probability of achieving the respective target pattern in the bingo-type game. The method next includes associating or mapping different pattern sets to each different prize level in a desired prize distribution. The target patterns and their respective pattern probabilities are assigned or mapped to the different pattern sets so that the individual pattern probabilities included in each pattern set add up to the desired probability of the prize level with which the pattern set is associated. In this way, a desired prize distribution may be used in a bingo-type game

14 Claims, 4 Drawing Sheets

| PRIZE LEVEL | PROBABILITY | PRIZE |
|---|---|---|
| 0 | .299 | $N_0$ |
| 1 | .3 | $N_1$ |
| 2 | .25 | $N_2$ |
| 3 | .15 | $N_3$ |
| 4 | .001 | $N_4$ |

301

300

| PATTERN ID | TARGET PATTERN | PATTERN PROBABILITY |
|---|---|---|
| P1 | STRAIGHT LINE | .2 |
| P2 | LETTER X | .1 |
| P3 | LETTER L | .1 |
| P4 | LETTER C | .05 |
| P5 | 4 CORNERS | .1 |
| P6 | SMALL FLAG | .05 |
| P7 | LARGE FLAG | .025 |
| P8 | SMALL BOX | .05 |
| P9 | LARGE BOX | .025 |
| P10 | BLACKOUT | .001 |
| P11 | NOTHING/OTHERS | .299 |

302

FIG. 3

| | | | | |
|---|---|---|---|---|
| 1 | 2 | 3 | 4 | 5 |
| 6 | 7 | 8 | 9 | 10 |
| 11 | 12 | 13 | 14 | 15 |
| 16 | 17 | 18 | 19 | 20 |
| 21 | 22 | 23 | 24 | 25 |

FIG. 4

| PRIZE LEVEL | PROBABILITY | PRIZE | PATTERN SET |
|---|---|---|---|
| 0 | .299 | $N_0$ | P11 (.299) |
| 1 | .3 | $N_1$ | P1, P2 (.2+.1=.3) |
| 2 | .25 | $N_2$ | P3, P4, P5 (.1+.05+.1=.25) |
| 3 | .15 | $N_3$ | P6, P7, P8, P9 (.05+.025+.05+.025=.15) |
| 4 | .001 | $N_4$ | P10 (.001) |

FIG. 5

| PRIZE LEVEL | PROBABILITY | PRIZE |
|---|---|---|
| 0 | .299 | $X_0$ |
| 1 | .35 | $X_1$ |
| 2 | .2 | $X_2$ |
| 3 | .1 | $X_3$ |
| 4 | .05 | $X_4$ |
| 5 | .001 | $X_5$ |

FIG. 6

| PRIZE LEVEL | PROBABILITY | PRIZE | PATTERN SET |
|---|---|---|---|
| 0 | .299 | $X_0$ | P11 (.299) |
| 1 | .35 | $X_1$ | P1, P2, P4 (.2+.1+.05=.35) |
| 2 | .2 | $X_2$ | P3, P5 (.1+.1=.2) |
| 3 | .1 | $X_3$ | P6, P8 (.05+.05=.1) |
| 4 | .05 | $X_4$ | P7, P9 (.025+.025=.05) |
| 5 | .001 | $X_5$ | P10 (.001) |

FIG. 7

METHOD FOR ASSIGNING PRIZES IN BINGO-TYPE GAMES

TECHNICAL FIELD OF THE INVENTION

This invention relates to bingo-type gaming systems. More particularly, the invention relates to a method for assigning prizes from a number of different prize levels available in a bingo-type game.

BACKGROUND OF THE INVENTION

Numerous gaming systems have been developed in which participants may be awarded prizes based on the result or outcome of a game play. The outcome of a game play in a gaming system may be determined in a number of different fashions. Video and electronic games available in casinos may determine a win or loss for each play of the game according to some algorithm. Lottery-type games rely on predetermined game records which are analogous to lottery tickets. Each game record is predetermined as being a winning or losing record, and winning records are associated with some prize. These predetermined game records are distributed to players in the course of game play, and a player receiving a winning record is entitled to the prize associated with that record.

Bingo-type games make up another general class of gaming systems. A bingo-type game is played with predetermined cards that include a number of symbols randomly arranged in a grid of spots or locations. The cards may be physically printed on paper or another suitable material or may be represented by a data structure which defines the various card locations and symbols associated with the locations. In the course of play, symbols are randomly selected from a pool of the symbols and matched to the symbols on the card. A card having matching symbols arranged in some predetermined pattern is considered a winning card.

A new type of gaming system is disclosed in U.S. Provisional Patent Application No. 60/265,100 entitled "Object Draw Gaming System and Program Product." The entire content of this provisional patent application is incorporated herein by this reference. This gaming system uses predetermined bingo-type cards, each card comprising a grid or other structure of locations and each location associated with one of a number of symbols. Outcomes in the game are determined by matching randomly selected symbols with the symbols on the player cards as in any bingo-type game. However, the matches and thus winning and losing player cards are determined prior to distributing the cards to the players. The matched or "daubed" cards are distributed in some random order to players in response to game play requests from the players. Preferably, each player card and each matched player card is represented by a data structure, and the data structure itself or related data for a matched card is distributed to a player in response to a request for a play in the game. The players make these game play requests through player terminals which are in communication with a central computer used to distribute the matched game cards or related data.

Lottery-type games are each associated with a prize distribution or prize table. The prize table assigns the various outcomes in the game to different prize levels. For example, a prize table may be patterned on a poker game with various poker hands related to the various prize levels in the game. In this example, the poker hand representation is a graphic representation of the outcome in the game. The different possible hands are each associated with, or assigned to, a particular prize level in the prize table. Other prize tables may have a reel-type game (slot machine) theme, some other traditional casino game theme, or a theme totally unrelated to traditional gaming.

It is desirable for the games available at a particular gaming establishment to have a variety of different prize distributions. This variety in prize distributions helps maintain player interest and makes the gaming experience more exciting. It is also desirable that each particular prize distribution include a diverse set of the available prizes. A diverse set of prizes available in a game helps make the game more interesting and enjoyable to the players.

One problem with bingo-type games is that the probability of winning or losing with a particular card is always determined by a fixed set of constraints. These constraints include the number of symbols available in the pool of symbols, the predetermined pattern or patterns to be matched, and the number of locations on the card (or card data structure). For a given set of constraints, the probabilities of winning and losing are generally fixed. Although it is possible to vary these bingo probabilities by varying these constraints, varying the constraints may be cumbersome. Also, even varying the constraints for the bingo game only has a limited effect on the resulting bingo probabilities.

Using bingo game probabilities to determine prize levels in a bingo-type game such as that described in U.S. Provisional Patent Application No. 60/265,100 would constrain the possible prize distribution for the game and prevent the use of a desirable prize table/prize distribution. It is therefore desirable to develop some new method of assigning or distributing prizes in bingo-type games in general, and particularly the bingo-type game described in U.S. Provisional Patent Application No. 60/265,100.

SUMMARY OF THE INVENTION

It is an object of the invention to provide a method for assigning bingo-type game prizes which overcomes the above-described problems associated with bingo-type games. The invention encompasses both a method for developing a desirable prize distribution for a bingo-type game and method for assigning prizes in a bingo-type game.

A method according to the invention includes determining a pattern probability for each of a number of target patterns achievable in a bingo-type game. Each pattern probability comprises a probability of achieving the respective target pattern in the bingo-type game. The method next includes associating or mapping a different pattern set to each different prize level in a desired prize distribution. The target patterns and their respective pattern probabilities are then assigned or mapped to the different pattern sets so that the individual pattern probabilities included in each pattern set add up to the desired probability of the prize level with which the pattern set is associated. In this way, a desired prize distribution may be developed for a bingo-type game. That is, the prize table or prize distribution for the bingo-type game need not be constrained to the bingo probabilities associated with achieving particular patterns in the game.

The target patterns may be any patterns that may be achieved in a bingo-type game. For example, a card for a bingo-type game may include a grid of the 5×5 spots or locations, with a symbol associated with each location in the grid. A target pattern within the scope of the invention may be any pattern which may be produced by the locations on the card. A target pattern may, for example, comprise a straight line of five locations, or two diagonal lines of locations forming an "X." Any other pattern may be used as a target pattern within the scope of the present invention, including patterns which do not form an identifiable shape.

For a given bingo-type game conducted with a given set of rules, each target pattern will be associated with a pattern probability. This pattern probability is the probability of a player achieving that particular pattern under the rules of play in the bingo-type game. For a certain number of target patterns there will be associated a corresponding number of target probabilities, each target pattern in the group associated with a characteristic pattern probability. As used in this disclosure and the accompanying claims, a "number" of elements such as a "number" of target patterns will mean some integer value greater than one, unless specifically stated otherwise. Thus, the phrase "a number of target patterns" refers to a group of more than one target pattern.

A desired prize distribution or prize table within the scope of the present invention will include a number of different prize levels. Each prize level in a desired prize distribution is associated with both a prize and a desired probability of winning that prize in the course of game play. It is important to note that according to the invention, a desired prize distribution may be any prize distribution. In particular, a desired prize distribution may be a distribution associated with some preexisting game such as a traditional poker game for example. A primary advantage of the present invention is that prizes may be awarded from the bingo-type game to produce any desired prize distribution and yet the individual prizes are determined by the underlying bingo-type game which is subject to the relatively fixed bingo probabilities.

The step of associating or mapping target patterns to the pattern sets/prize levels may be accomplished in many different ways. For example, the target patterns may be chosen manually for inclusion in a particular pattern set, or chosen according to some rule. Target patterns may also be selected for the various pattern sets in some automated fashion according to an algorithm. The only constraint according to the present invention is that the pattern probabilities of target patterns included in each individual pattern set must add together or sum to a value which approximates the probability of the prize level with which that pattern set is associated. It will be appreciated that the pattern probabilities in a given pattern set may not total exactly to the desired prize level probability. However, it is the goal of the invention to associate or map target patterns and their respective pattern probabilities to pattern sets so that the pattern probabilities in each set total to a value approximately equal to the probability associated with the respective prize level with which the pattern set is associated. The allowable variation between the sum of pattern probabilities in a pattern set and the respective prize level probability may be significant, however, in every case the target patterns and respective pattern probabilities are selected for inclusion in a pattern set based at least partially upon the desired prize level probability with which the pattern set is associated.

According to the present invention, prizes from the desired prize distribution or prize table are awarded in the bingo-type game according to the pattern set with which an achieved target pattern is associated. For example, a prize level associated with prize X in a given prize distribution may be associated or mapped to a pattern set including three target patterns, patterns A, B, and C. A player holding a card that achieves pattern A in the bingo-type game will be awarded this prize X. Players holding cards that achieve target patterns B and C will also be awarded prize X.

An advantage of present invention is that once pattern probabilities are determined for a bingo-type game under given rules of play, these probabilities may be used to develop a number of different prize distributions or prize tables for games using the same underlying bingo-type game. Specifically, after target patterns/pattern probabilities are mapped to the various prize levels of a first desired prize distribution, the method according to the invention may include mapping target patterns/pattern probabilities to additional pattern sets associated with prize levels of an entirely different prize distribution or prize table. Once again, each target pattern and its respective pattern probability is mapped to the various additional pattern sets so that the pattern probabilities in each set total approximately to the probability of the additional prize level with which the respective pattern set is associated.

These and other objects, advantages, and features of the invention will be apparent from the following description of the preferred embodiments, considered along with the accompanying drawings.

BRIEF DESCRIPTION OF THE DRAWINGS

FIG. 3 shows a group of pattern probabilities for a bingo-type game.

FIG. 4 shows a grid which may be used in a bingo-type game employing the target patterns defined in FIG. 3.

FIG. 5 is a table showing pattern sets mapped to the various prize levels of the prize distribution shown in FIG. 1, and showing the target patterns of FIG. 3 mapped to the various pattern sets.

FIG. 6 shows an additional or alternative prize distribution which may be used according to the present invention.

FIG. 7 is a table showing pattern sets mapped to the various prize levels of the prize distribution shown in FIG. 6, and showing the target patterns of FIG. 3 mapped to the various pattern sets.

DESCRIPTION OF THE PREFERRED EMBODIMENTS

Figures 1, 2:
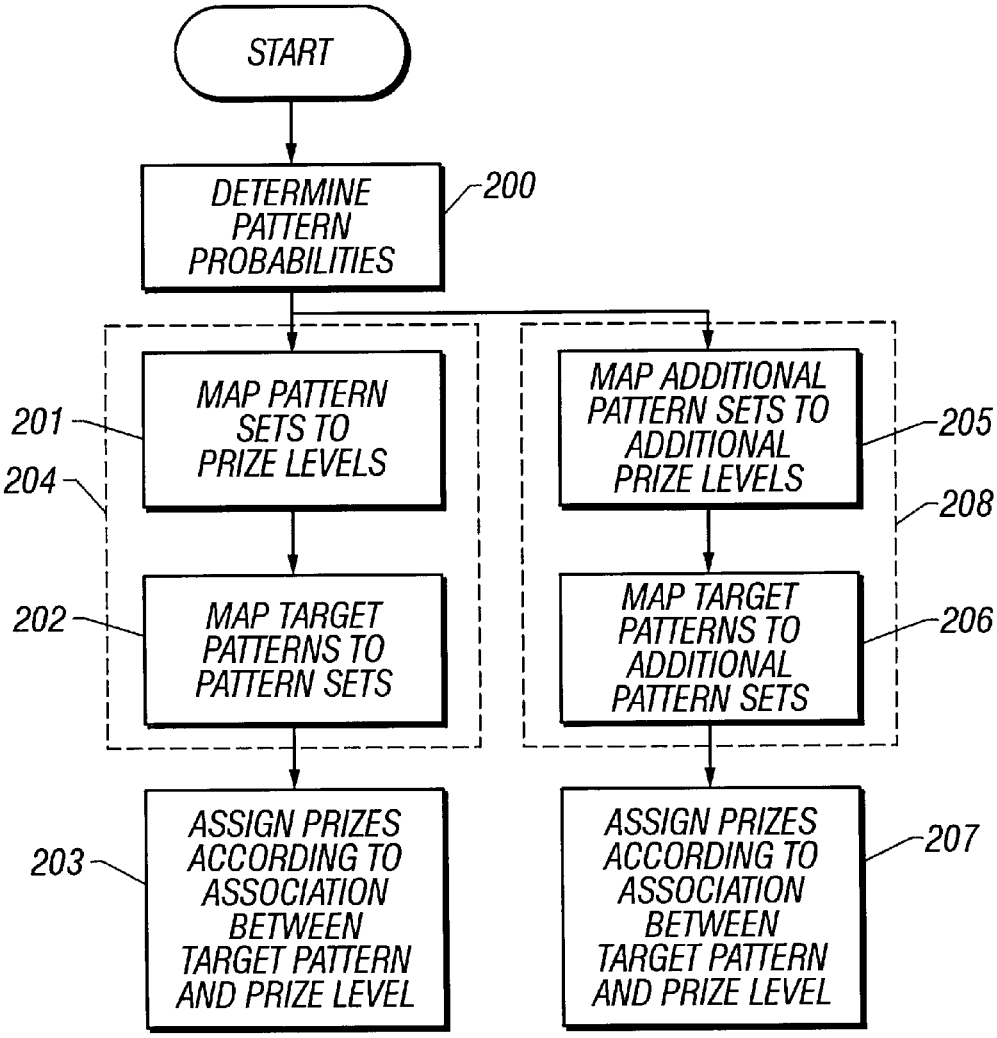
FIG. 1 shows an example prize distribution or prize table which may be used according to the present invention.
FIG. 2 is a flow chart showing the process steps according to the present invention.

FIG. 1 shows a prize distribution or prize table with which the present invention may be employed. The prize distribution shown in FIG. 1 includes five prize levels, levels 0 through 4. The first column of FIG. 1 shows the prize level, while the second column shows an exemplary desired probability for winning at that particular prize level in the game. For example, level 0 is associated with the probability 0.299. The final column in each entry in FIG. 1 contains a prize value associated with the particular prize level. Prize level 0 is associated with prize value No, for example.

The prize levels and probabilities for a prize distribution within the scope of the invention may be developed in any suitable manner. Developing prize distributions in gaming systems is well known in the art and will not be described in detail here so as not to obscure the invention in unnecessary detail. It will be appreciated that a prize distribution which may be used with the present invention is not limited to five levels as shown for purposes of example in FIG. 1, and is not limited to any particular probabilities at each level. A particular prize distribution used with the invention may have more or fewer prize levels than the five shown in FIG. 1. The prize levels may be chosen to imitate a preexisting game, or an entirely new type of game. It will also be appreciated that each prize level in a prize distribution may be associated with several different prize values. The different prize values may correspond to different wagers that may be made by a player in a game which uses the prize distribution.

Referring now to FIG. 2, the method of the invention includes determining the probabilities for several target patterns which may be achieved in a bingo-type game under given rules of play. This pattern probability determination step is shown at process block 200 in FIG. 2. FIG. 3 shows a number of different target patterns, each target pattern associated with an example pattern probability. Each row in FIG. 3 is dedicated to a particular target pattern and includes a target pattern label or identifier 300 in the first column, a target pattern definition or description 301 in the second column, and the actual probability 302 of achieving that target pattern in the final column. For example, the first row in FIG. 3 shows that the target pattern "straight line" is associated with the probability 0.2 and for purposes of this disclosure is identified with the label P1. The number of patterns shown in FIG. 3 is shown only for purposes of description. More or fewer pattern definitions may be used according to the present invention. Also, it should be noted that the example probability values shown in the final column of FIG. 3 are purely fictional and are selected simply for convenience in describing the present invention. Depending upon the rules of game play in the bingo-type game, many different probabilities may be created for the described patterns. For example, in the actual implementation described below, the black out pattern is actually associated with the highest probability in the group of probabilities, and not the lowest as indicated in FIG. 3. Also, it should be noted that a pattern used in the invention may be an identifiable pattern, an unidentifiable pattern, or a composite of the two. For example, a pattern may be defined as a pattern for the letter "M." Another pattern may be defined as a pattern making the letter "M," plus any one or more other locations on the grid. Yet another pattern may be defined as some arbitrary arrangement of daubed locations on a grid.

The patterns described in FIG. 3 are patterns suitable for use in a game using game cards each comprising or representing a grid, with each location on the grid associated with a symbol or indicia. FIG. 4 shows such a grid having five columns and five rows. Each location is labeled in the drawing with a numerical identifier for purposes of describing the present invention. The symbols which would be associated with the various locations are not shown in FIG. 4. With the grid-type game card shown in FIG. 4, the target pattern identified at P3 in FIG. 3, the "letter L" target pattern, is defined by locations 1, 6, 11, 16, 21, 22, 23, 24, and 25. A straight line identified as target pattern P1 may be any straight line of locations on the grid such as the top row locations 1, 2, 3, 4, and 5, or the diagonal line defined by locations 1, 7, 13, 19, and 25 for example.

It will be appreciated that the grid-type game card shown in FIG. 4 is shown only for purposes of example. The invention is not limited to that particular card definition or to target patterns which may be defined in the illustrated 5×5 grid in FIG. 4 or any other size of grid. Rather, the present invention has application to any bingo-type or pattern matching game using predefined cards (that is, predefined symbol structures) with a predefined symbol distribution, where the outcome of the game for a particular card or symbol structure is determined by the pattern formed on the card when the card symbols are matched to symbols randomly selected from a pool of symbols.

Referring again to FIG. 2, once the pattern probabilities are determined for the bingo-type game, the method includes the step of associating or mapping a different pattern set to each prize level in the desired prize distribution. This mapping step is shown at process block 201 in FIG. 2. As shown at block 202 in FIG. 2, the method also includes associating or mapping the various target patterns and respective pattern probabilities to each pattern set. FIG. 5 shows example pattern sets for the prize distribution shown in FIG. 1 and the target patterns shown in FIG. 3. According to the invention, the pattern probabilities in each pattern set may be added together or summed to produce a numerical value approximating the probability associated with the respective prize level to which the pattern set is mapped or associated. Referring to the first row in FIG. 5 for example, prize level 0 is associated with or mapped to a pattern set shown in the final column and comprising target pattern P11. This target pattern encompasses all patterns other than the patterns defined in FIG. 3. The pattern probability associated with this target pattern is shown in parentheses in the final column of FIG. 5 and equals the probability associated with prize level 0. Referring to prize level 1, the pattern probabilities associated with target patterns P1 and P2 sum together to equal 0.3, the desired probability associated with prize level 1. For prize level 2, the pattern probabilities associated with patterns P3, P4, and P5 add together to equal 0.25, the probability associated with prize level 2. Referring to the next row down in FIG. 5 for prize level 3, the probabilities associated with target patterns P6, P7, P8, and P9 add together to 0.15, which is the probability associated with prize level 3. The pattern set shown in the final row of FIG. 5 is mapped to prize level 4. This pattern set includes only a single target pattern, pattern P10. The pattern probability of target pattern P10 equals the desired probability associated with prize level 4, 0.001.

As indicated by the dashed box 204 around process blocks 201 and 202, the individual steps of mapping pattern sets to the various prize levels and mapping target patterns to those sets may be thought of as a single step. That is, the invention is not limited to first assigning or mapping pattern sets to the various prize levels and then assigning or mapping target patterns to the various pattern sets. The act of assigning or mapping a given target pattern or target pattern probability to a prize level effectively assigns or associates a pattern set with the prize level. That associated set includes the assigned target pattern or target pattern probability and may include other target patterns or target pattern probabilities that may be assigned or mapped to that prize level.

Referring again to FIG. 2, once the target patterns and respective pattern probabilities are mapped to the prize levels as indicated at process block 202, prizes may be distributed or assigned in a game based on the association or relationship between the target patterns achieved in a game and the respective prize levels to which those target patterns are mapped. This assignment of prizes is shown at process block 203 in FIG. 2. For example, assume that a player holds a game card which produces a straight line in the play of the bingo-type game. The straight line target pattern P1 is mapped to prize level 1 as shown in FIG. 5. Thus, the player is awarded the prize associated with prize level 1, prize $N_1$ shown in FIG. 5. As another example, assume a player holds a game card which produces the letter "C" pattern in the course of play. This letter "C" pattern is shown as target pattern P4 in FIG. 3. Since target pattern P4 is included in the pattern set mapped to prize level 2 as shown in FIG. 5, the player holding the game card producing the "C" target pattern is awarded prize $N_2$ associated with prize level 2. As yet another example, assume a player in the bingo-type game holds a card that produces a "black out" (target pattern P10) in the course of play. Target pattern P10 is mapped to prize level 4, and thus the player holding this card is awarded prize $N_4$, associated with prize level 4.

As indicated at process block 205 in FIG. 2, the method according to the invention may also include associating or mapping a pattern set to each prize level of an additional prize distribution. The method may further include mapping target patterns and pattern probabilities to each pattern set as shown at process block 206. Similar to the steps shown at process blocks 201 and 202, the steps shown at process blocks 205 and 206 may be considered a single step as indicated by the dashed box 208. FIG. 6 shows an additional prize distribution or prize table which is different from the prize distribution shown in FIG. 1. Not only are the probabilities associated with some of the prize levels different from those shown in FIG. 1, but also the prize distribution shown in FIG. 6 includes six prize levels. The pattern sets and target patterns mapped according to these six different prize levels are shown in FIG. 7. In this case, target pattern P1 is mapped to the pattern set associated with prize level 1. Target patterns P2 and P4 are also mapped to the pattern set associated with prize level 1. Once again, the pattern probabilities included in each pattern set add together to result in a numerical value which approximates the probability associated with the prize level to which the pattern probability is mapped. In the example shown in the second row of FIG. 7 for prize level 1, the probabilities of target patterns P1, P2, and P4 (0.2, 0.1, and 0.05, respectively) add up to 0.35, the desired probability of winning at prize level 1 in the prize distribution shown in FIGS. 6 and 7.

Once the target patterns and pattern probabilities are mapped, prizes may be assigned to game players based on the association between the target patterns and the respective prize levels to which they are mapped. This prize assignment step is shown at process block 207 in FIG. 2. For example, for the mapping shown in FIG. 7, a player holding a card that produces a straight line in the course of the bingo-type game is awarded the prize associated with prize level 1. A player holding a card that produces a letter "C" target pattern, pattern P4, is awarded the prize associated with prize level 1. Note that target pattern P4 is mapped to prize level 2 in the example shown in FIG. 5, but mapped to prize level 1 in the example shown in FIG. 7.

It will be noted by comparing FIGS. 5 and 7, that the very same group of target patterns and pattern probabilities (shown in FIG. 3) may be mapped according to the invention to produce two entirely different prize distributions for distributing prizes in the bingo-type game for which the pattern probabilities are determined. Depending upon the number of target patterns for which pattern probabilities are determined, the same target patterns and pattern probabilities may be mapped in many different ways to produce numerous different prize distributions. These different prize distributions may be used for numerous different games portrayed to game players. Yet the outcome of a play in each game is determined entirely by the underlying matched pattern of a single type of bingo game, just as in any bingo-type game, whether the symbols for a game are produced using an object draw system or a randomly selected in some other way.

In the examples shown in FIGS. 5 and 7, the pattern probabilities mapped to the various pattern sets each add up exactly to the desired prize probability associated with the prize level to which the pattern probabilities are mapped. These simple examples are shown only for purposes of convenience and to facilitate the description of the invention. It will be appreciated that in a real world example of pattern probabilities, it may not be possible to map the pattern probabilities so that probability values add up exactly to the desired prize level probabilities. However, it is the goal of the present invention that the pattern probabilities may be mapped to approximate the desired prize level probabilities. As used in this disclosure and the accompanying claims, the word "approximate" is used in connection with the pattern probability totals in a pattern set to indicate that the target patterns and pattern probabilities are chosen for the set with the desired prize level probability in mind. To facilitate the desired approximation of desired prize level probabilities, game cards and target patterns may be chosen to provide a wide variety of available pattern probabilities to be mapped to the various pattern sets and prize levels. Having a relatively larger number of target patterns and respective pattern probabilities which may be mapped provides relatively more flexibility in producing pattern sets with pattern probabilities that total to the desired prize level probabilities.

Although the pattern probabilities may be determined in any fashion, they will in any case be dependent upon the rules of play for the underlying bingo-type game. Those rules of play may be selected to provide a diverse group of pattern probabilities for mapping to the various pattern sets according to the invention. The rules of play for the underlying bingo-type game are preferably chosen to ensure no player has an advantage over the other players in the game.

One preferred implementation uses a card perm of five by five bingo cards with each of the twenty-five locations on each card associated with a number from 1 through 75. The card perm is limited so that every number shows up 81 times and so that each card is unique, that is, no two cards have the same 25 numbers. This results in a perm of 243 cards.

This preferred implementation defines the "stop pattern" for the bingo-type game as a blackout pattern in which all locations on a card are matched by numbers drawn randomly from the pool of numbers 1 through 75. The numbers are chosen randomly using a ball draw device or ball draw simulation device in which 75 balls are marked with the numbers 1 through 75, mixed together and then drawn randomly to produce the desired random sequence of numbers. This example implementation is limited to use only games that end on exactly 65 balls. All other games are discarded. Approximately 15 percent of all games should end on exactly 65 balls.

For each game, the perm of 243 cards is shuffled so that the cards are in a random order. Balls are then drawn from the pool of balls numbered 1 through 75, and on each draw the cards are evaluated one at a time in the shuffled order to determine if the stop pattern has been produced on any card. If the stop pattern is produced on a single card before the 65th ball is drawn or where no stop pattern is detected after the 65th ball is drawn, the game is discarded and the process begins again. If the stop pattern is detected on the 65th ball, all cards in the randomly shuffled perm after the first detected stop pattern are discarded and all cards before the card which achieved the stop pattern are evaluated for other patterns which are defined as some level of winning pattern. The resulting set of cards containing both winning and losing cards are placed in the order they were produced for distribution to players as described in U.S. provisional patent application No. 60/265,100 entitled "Object Draw Gaming System and Program Product."

Based on these rules of play for the bingo-type game, the probabilities of each individual target pattern occurring is determined through simulation or other suitable technique.

Once the probabilities are determined, the pattern set and target pattern mapping steps shown in FIG. 2 are performed. In the example implementation, the stop pattern is assigned to the highest probability prize level in the desired prize distribution. Starting next with the highest, least probable prize level in the prize distribution and the least probable individual pattern probability, the individual target patterns are mapped to that prize level until the individual pattern probabilities total to near the desired prize level probability for that prize level. Once target patterns and pattern probabilities are mapped to the least probable prize level in the desired prize distribution, mapping continues with the pattern set for the next least probable prize level in the prize distribution using the remaining target patterns and target probabilities. The process continues until all target patterns have been mapped.

In another implementation of the invention, pattern sets are limited to patterns which produce some recognizable arrangement, or patterns which include the recognizable arrangement. For example, a pattern set may be based upon patterns in a five-by-five bingo card or card representation that make up at least the letter "M." This "M" pattern would be defined by locations 1, 6, 11, 16, 21, 7, 13, 9, 5, 10, 15, 20, and 25 in the card shown in FIG. 4. The pattern set would include this "M" pattern and patterns which make the letter "M" plus have additional locations daubed, locations 2 and 3 in FIG. 4 for example. It will be appreciated that this implementation of the invention requires that the base recognizable pattern (or patterns) for each pattern set be selected carefully so that the probabilities of the patterns in that resulting set add up to the desired prize level probability. It will also be appreciated that the patterns which fall in a given pattern set (according to a particular rule) must be removed from the available pool of patterns which may be assigned to other pattern sets. That is, a given pattern may be assigned only to a single pattern set according to the invention. Otherwise a given pattern could be associated with more than one prize level, which would be an undesirable result.

The above-described preferred embodiments are intended to illustrate the principles of the invention, but not to limit the scope of the invention. Various other embodiments and modifications to these preferred embodiments may be made by those skilled in the art without departing from the scope of the following claims. It will be appreciated that the invention applies equally to bingo-type games using paper cards or bingo-type games using data structures to define game cards. Also, although the present invention has particular application to bingo-type games as described in U.S. Provisional Patent Application No. 60/265,100, the prize assignment method according to the invention may be used with other bingo-type games, including traditional bingo games.

What is claimed is:

1. A method for developing a desired prize distribution in a gaming system in which a set of symbols is matched to a number of predefined symbol structures to produce a respective pattern of matches for each symbol structure and in which the pattern of the matches for the respective symbol structure determines a game outcome for the respective symbol structure, the desired prize distribution comprising a number of different prize levels, each prize level being associated with a desired probability of winning that particular prize, the method comprising the steps of:

(a) determining a pattern probability for each of a number of target patterns achievable in the gaming system, each pattern probability comprising a probability of achieving the respective pattern with a respective one of the symbol structures; and (b) associating a different pattern set with each different one of the prize levels in the desired prize level distribution, each respective pattern set containing at least one target pattern and its respective pattern probability with each target pattern and respective pattern probability included in no more than one pattern set, the target patterns and respective pattern probabilities being assigned to the pattern sets so that the sum of pattern probabilities included in each pattern set approximates the desired probability of the respective prize level with which the respective pattern set is associated.

2. The method of claim 1 wherein one of the target patterns is achieved by a player in the gaming system, and the method includes the step of awarding that player the prize level associated with the respective pattern set in which the achieved target pattern is included.

3. The method of claim 1 wherein an additional desired prize level distribution includes a number of different prize levels, each prize level associated with a desired prize level probability, and further including the step of:

(a) associating a different additional pattern set with each different prize level of the additional desired prize level distribution, each respective additional pattern set containing at least one target pattern and its respective pattern probability with each target pattern and respective pattern probability included in no more than one additional pattern set, the target patterns and respective pattern probabilities being assigned to the additional pattern sets so that the sum of pattern probabilities included in each additional pattern set approximates the desired probability of the respective prize level with which the respective additional pattern set is associated.

4. The method of claim 1 wherein each target pattern in each respective pattern set is defined according to an identifiable pattern.

5. A method for developing a desired prize distribution in a game system in which a set of symbols is matched to a number of symbol structures to produce a respective pattern of matches for each symbol structure and in which the pattern of the matches for the respective symbol structure determines a game outcome for the respective symbol structure, the desired prize distribution comprising a number of different prize levels and for each different prize level a desired probability of winning that particular prize level, the method comprising the steps of:

(a) determining a pattern probability for each of a number of target patterns achievable in the gaming system, each pattern probability comprising a probability of achieving the respective pattern with a respective one of the symbol structures;

(b) associating a different pattern set with each different one of the prize levels in the desired prize level distribution; and (c) mapping at least one target pattern and its respective pattern probability to each respective pattern set with each target pattern and respective pattern probability included in no more than one pattern set, the target patterns and respective pattern probabilities being mapped to the pattern sets so that the sum of pattern probabilities included in each pattern set approximates the desired probability of the respective prize level with which the respective pattern set is associated.

6. The method of claim 5 wherein one of the target patterns is achieved by a player in the gaming system, and the method includes the step of awarding that player the prize level associated with the respective pattern set to which the achieved target pattern is mapped.

7. The method of claim 5 wherein an additional desired prize level distribution includes a number of different prize levels, each prize level associated with a desired prize level probability, and further including the step of:

(a) associating a different additional pattern set with each different prize level of the additional desired prize level distribution; and (b) mapping at least one target pattern and its respective pattern probability to each additional pattern set with each respective pattern probability included in no more than one additional pattern set, the target patterns and respective pattern probabilities being mapped to the additional pattern sets so that the sum of pattern probabilities included in each additional pattern set approximates the desired probability of the respective prize level with which the respective additional pattern set is associated.

8. The method of claim 5 wherein each target pattern in each respective pattern set is defined according to an identifiable pattern.

9. A method of assigning prizes from a desired prize distribution to patterns in a bingo-type gaming system, the desired prize distribution comprising a number of different prize levels, each prize level being associated with a desired probability of winning a prize associated with that particular prize level, the method comprising the steps of:

(a) determining a pattern probability for each of a number of target patterns achievable in the bingo-type gaming system, each pattern probability comprising a probability of achieving the respective pattern in the bingo-type gaming system;

(b) associating a different pattern set with each different one of the prize levels in the desired prize level distribution, each respective pattern set containing at least one target pattern and its respective pattern probability with each target pattern and respective pattern probability included in no more than one pattern set, the target patterns and respective pattern probabilities being assigned to the pattern sets so that the sum of pattern probabilities included in each pattern set approximates the desired probability of the respective prize level with which the respective pattern set is associated; and (c) for each target pattern achieved by a player in the course of game play, awarding that player the prize level associated with the respective pattern set in which the achieved target pattern is included.

10. The method of claim 9 wherein each target pattern in each respective pattern set is defined by an identifiable pattern.

11. The method of claim 9 wherein an additional desired prize level distribution includes a number of different prize levels, each prize level associated with a desired prize level probability, and further including the step of:

(a) associating a different additional pattern set with each different prize level of the additional desired prize level distribution, each respective additional pattern set containing at least one target pattern and its respective pattern probability with each target pattern and respective pattern probability included in no more than one additional pattern set, the target patterns and respective pattern probabilities being assigned to the additional pattern sets so that the sum of pattern probabilities included in each additional pattern set approximates the desired probability of the respective prize level with which the respective additional pattern set is associated.

12. A method for developing a desired prize distribution in a gaming system which utilizes pattern matching to determine game play outcomes, the desired prize distribution comprising a number of different prize levels, each prize level being associated with a desired probability of winning that particular prize, the method comprising the steps of:

(a) determining a pattern probability for each of a number of target patterns achievable in the gaming system, each pattern probability comprising a probability of achieving the respective pattern in the gaming system; and (b) associating a different pattern set with each different one of the prize levels in the desired prize level distribution, each respective pattern set containing at least one target pattern and its respective pattern probability, with at least one respective pattern set containing two or more target patterns and their respective pattern probabilities, and with each target pattern and respective pattern probability included in no more than one pattern set, the target patterns and respective pattern probabilities being assigned to the pattern sets so that the sum of pattern probabilities included in each pattern set containing two or more pattern probabilities approximates the desired probability of the respective prize level with which the respective pattern set is associated.

13. A method for developing a desired prize distribution in a game system utilizing pattern matching against a number of respective symbol structures to determine an outcome associated with each respective symbol structure, the desired prize distribution comprising a number of different prize levels and for each different prize level a desired probability of winning that particular prize level, the method comprising the steps of:

(a) determining a pattern probability for each of a number of target patterns achievable in the gaming system, each pattern probability comprising a probability of achieving the respective pattern with a respective one of the symbol structures;

(b) associating a different pattern set with each different one of the prize levels in the desired prize level distribution; and (c) mapping at least one target pattern to each respective pattern set, with at least one pattern set having two or more target patterns mapped thereto, and with each target pattern included in no more than one pattern set, the target patterns being mapped to the pattern sets so that the sum of pattern probabilities associated with the target patterns included in each pattern set having two or more target patterns approximates the desired probability of the respective prize level with which the respective pattern set is associated.

14. A method of assigning prizes from a desired prize distribution to patterns in a bingo-type gaming system, the desired prize distribution comprising a number of different prize levels, each prize level being associated with a desired probability of winning a prize associated with that particular prize level, the method comprising the steps of:

(a) determining a pattern probability for each of a number of target patterns achievable in the bingo-type gaming system, each pattern probability comprising a probability of achieving the respective pattern in the bingo-type gaming system;

(b) associating a different pattern set with each different one of the prize levels in the desired prize level distribution, each respective pattern set containing at least one target pattern, with at least one respective pattern set including two or more target patterns, and with each target pattern included in no more than one pattern set, the target patterns being assigned to the pattern sets so that the sum of the respective pattern probabilities associated with the target patterns included in each pattern set having two or more target patterns approximates the desired probability of the respective prize level with which the respective pattern set is associated; and (c)for each target pattern achieved by a player in the course of game play, awarding that player the prize level associated with the respective pattern set in which the achieved target pattern is included.

* * * * *